US006428132B1

(12) United States Patent
Kubatzki et al.

(10) Patent No.: US 6,428,132 B1
(45) Date of Patent: Aug. 6, 2002

(54) METHOD FOR DETERMINING THE NUMBER OF NORMAL IMPRINTS IMPLEMENTABLE WITH A REMAINING INK QUANTITY AND ARRANGEMENT FOR THE IMPLEMENTATION OF THE METHOD

(75) Inventors: Ralf Kubatzki; Wolfgang Thiel, both of Berlin (DE)

(73) Assignee: Francotyp-Postalia AG & Co., Birkenwerder (DE)

( * ) Notice: Subject to any disclaimer, the term of this patent is extended or adjusted under 35 U.S.C. 154(b) by 0 days.

(21) Appl. No.: 09/723,082

(22) Filed: Nov. 27, 2000

(30) Foreign Application Priority Data

Nov. 26, 1999 (DE) ..... 199 58 948

(51) Int. Cl.[7] ..... B41J 2/195
(52) U.S. Cl. ..... 347/7
(58) Field of Search ..... 347/7, 19, 23, 347/5, 15; 399/27, 19

(56) References Cited

U.S. PATENT DOCUMENTS

| | | | | |
|---|---|---|---|---|
| 4,196,625 | A | | 4/1980 | Kern |
| 4,415,886 | A | * | 11/1983 | Kyogoku et al. ..... 347/618 |
| 4,994,853 | A | * | 2/1991 | Fukuchi et al. ..... 355/208 |
| 5,710,721 | A | | 1/1998 | Rieckhoff et al. |
| 5,712,667 | A | * | 1/1998 | Sato ..... 347/7 |
| 5,771,348 | A | | 6/1998 | Kubatzki et al. |
| 5,788,388 | A | * | 8/1998 | Cowger et al. ..... 400/703 |
| 5,835,817 | A | * | 11/1998 | Bullock et al. ..... 399/25 |
| 5,856,834 | A | | 1/1999 | Murphy, III |
| 6,059,402 | A | | 5/2000 | Martens |
| 6,151,039 | A | * | 11/2000 | Hmelar et al. ..... 347/7 |
| 6,276,777 | B1 | * | 8/2001 | Schiaffino et al. ..... 347/17 |

FOREIGN PATENT DOCUMENTS

| | | | |
|---|---|---|---|
| DE | 195 49 376 | | 9/1996 |
| DE | 198 12 903 | | 9/1999 |
| EP | 443832 | * | 8/1991 |
| EP | 0 443 832 | | 8/1991 |
| EP | 841173 | * | 5/1998 |
| EP | 0 875 862 | | 11/1998 |
| EP | 0 882 595 | | 12/1998 |
| EP | 0 885 731 | | 12/1998 |
| GB | 2 344 565 | | 6/2000 |

* cited by examiner

*Primary Examiner*—Craig Hallacher
*Assistant Examiner*—Ly T Tran
(74) *Attorney, Agent, or Firm*—Schiff Hardin & Waite

(57) ABSTRACT

In a method for determining the number of normal imprints implementable in a printing device with a remaining ink quantity, to a computational determination of this number is made when a sensor-acquired, predetermined remaining ink quantity is signaled. In an arrangement for the implementation of the method, a microprocessor is programmed to undertake a rough computational determination of the remaining number of imprints to signal the need to change the ink tank cassette before the reserve quantity is tapped for use, to generate a message after a recognition of the change of the ink tank cassette, and to display it on a display. The microprocessor waits for an entry of a code via an input unit. Upon entry of the code, the microprocessor implements a check of the input code as to whether the changed ink tank cassette is authorized, and modifies the operation of the device if the completed check of the code has yielded an invalidity. The microprocessor undertakes a fine computational determination of the remaining number of imprints from a point in time at which the predetermined remaining ink quantity acquired by the sensor is signaled. The input of the code can ensue by chip card.

21 Claims, 6 Drawing Sheets

METHOD FOR DETERMINING THE NUMBER OF NORMAL IMPRINTS IMPLEMENTABLE WITH A REMAINING INK QUANTITY AND ARRANGEMENT FOR THE IMPLEMENTATION OF THE METHOD

BACKGROUND OF THE INVENTION

1. Field of the Invention

The present invention is directed to a method and arrangement for determining the number of normal imprints implementable with a remaining ink quantity that can be generated by a device having at least one ink jet print head. The invention can be employed for determining the ink supply in ink tank cassettes for postage meter machines that print with an ink jet print head and allows the maximum utilization until the ink tank cassette is replaced.

2. Description of the Prior Art

Postage meter machines have been known since the 1920's and are still being constantly perfected. The printing principle has changed from original, purely mechanical solutions with printing drums to electronic solutions with thermal transfer or ink jet printing head. The franking imprint must be capable of being read visually and by machine by the postal authorities in order to be able to verify the payment of postage.

An ink that has not been inspected by the manufacturer or not approved by the manufacturer represents a risk to the legibility of the franking imprint. At time intervals, the used ink must be replaced by new ink, or the ink cassette must be replaced. It is in the interest of the manufacturer's customers and of the postal service to use qualitatively high-grade, proper material.

Indicating an impending change of consumable via a display is disclosed; in German Published Application 195 49 376, wherein sensors are used for determining the remaining amount of an inking ribbon on inking ribbon cassette for a thermal transfer printer or to count the number of imprints with the controller of the thermal transfer printer. This solution, however, is only suited for a thermal transfer postage meter machine, such as for the model Type T1000 offered by Francotyp-Postalia AG & Co., and cannot simply be transferred to postage meter machines with ink jet printers, due to the non-linear relationship between the remaining quantity of ink and number of imprints in such machines.

German Patent 196 13 944 discloses an ink cassette with two approximately identically constructed ink reservoirs that is suitable for the JetMail® type of postage meter machine also offered by Francotyp-Postalia AG & Co. One ink reservoir serves for disposal of ink collected during priming. The other ink reservoir serves for ink supply and has an end of ink detection with two electrodes, but does not supply information about the filling level either before or after the end signal. A perforation encoding that has also been disclosed does not offer adequate protection against a utilization of an ink tank cassette that is not authorized by the manufacturer of the postage meter machine.

And end of ink detection with electrodes is known from German Patent 27 28 283. Two electrodes for a comparative measurement and a separate electrode for a conductivity measurement for signaling the end of ink are introduced into the floor of the ink reservoir. The transfer impedance between these electrodes is measured with an electronic circuit and is interpreted. The electrodes are arranged in troughs that are formed in the reservoir base. A pre-condition for the use of such an end of ink recognition is the employment of an electrically conductive ink. Such sensors for detecting the end of ink already supply the JetMail® postage meter machine with an end signal when a maximum of 200 frankings are still possible in order to avoid an incompletely printed franking imprint that has already been debited due to lack of ink. However, a cleaning with ejection (priming) and/or extraction of ink is then no longer possible. The end signal is usually emitted too late to re-order an ink tank when large quantities of mail are processed, and too early when small quantities of mail are processed.

Cassette-shaped containers with ink fluid, inking ribbon or toner are disclosed in U.S. Pat. No. 5,365,312, having an integrated circuit chip with an electronic memory for a code identifying the reservoir, for expiration data and other data, as well as with a counter in order to identify the consumption during printing by counting the individual print pulses, which correspond to the drops of ink that are printed out (ejected). The integrated circuit stores the current filling status and this can be read out and displayed by the printer controller. A reprogramming of the chip and a refilling of the container, however, are not possible. The ink cassette with the chip counts the individual drops and allows use in office printers. The high technical outlay for counting drops, however, is justified only for printing wherein one must expect extremely large differences in consumption for different print images. Due to the large differences in the nature of the print images, however, no conclusion can be made regarding the number of printings that are still possible with a remaining quantity of ink.

European Application 875 862 discloses an ink jet print head for postage meter machines that carries an integrated ink tank and a connector with many contacts and a chip for storing a head identification number and a count. The count corresponds to the number of maximally possible franking imprints, and franking can be carried out with the postage meter machine only when the head identification number is authorized and the maximum number of franking imprints has not yet been reached. This solution can be utilized for ink jet printer postage meter machines only because an essentially constant ink consumption can be expected for franking, particularly stacks of mail. Only the ink consumption is indicated. The user of a postage meter machine, however, would like to be certain that a franking imprint that has been debited can always be completely printed, i.e. even when the end of ink is near. The above solution therefore is unsuitable for ink jet printer postage meter machines. Counting the (normal) imprints cannot supply any information about the number of possible imprints with the amount of ink remaining in the ink tank because, given a low through medium number of frankings per day, the consumption of ink due to the cleaning procedure predominates, which reduces the number of possible imprints per ink tank fill. Given piezo ink jet print heads, a large part of the ink is lost in cleaning with priming and extraction and cannot be re-supplied to the head.

U.S. Pat. No. 5,856,834 discloses a device and method for monitoring the ink consumption in an ink cartridge of a postage meter machine. This device has respective microprocessors in the meter (vault), in the base and at the print head. For cleaning the ink jet print head, the base microprocessor activates a pump station and activates the print head microprocessor and an ASIC for head rinsing. The cleaning and rinsing can be undertaken with different intensities. Compared to a cleaning, a rinsing causes in ink consumption that is reduced by two through four orders or magnitude, which is taken into consideration by software in the base microprocessor. A strong rinsing, "power flush" causes an ink consumption comparable to a franking imprint with an advertizing slogan. Upon initialization of the print head, however, ten times the ink is consumed compared to an intense cleaning, "power purge". Logically, high ink consumption would be disadvantageous when there is only a small residue of ink in the cartridge. The consumption due to cleaning and rinsing is therefore reduced when the ink consumption falls below a predetermined threshold. Since a safety margin is also embodied in the calculations, the device is able to "know" that the remaining quantity of ink is still sure to suffice for a large number of imprints. The agreement between the calculated and the actual consumption deviates more greatly at the pre-calculated end of ink than at the beginning of the calculation because all influencing factors are not able to be taken into account. If information about remaining ink quantity were determined from the consumption, then the imprecision would be greatest close to the end of ink. The number of imprints for which the remaining ink quantity suffices cannot be predicted. A safety margin must be selected large enough so that the ink is not exhausted earlier than calculated. The refilling of the cartridge with ink is in fact fundamentally possible, but the calculation is fatally compromised if the refilling is implemented imprecisely or incompletely. In this respect, it is disadvantageous when the consumption is only calculated in order to be able to draw conclusions about the remaining quantity of ink therefrom.

The employment of expired, old inks and poor quality inks that are supplied by other manufacturers for refilling, particularly these referred to as pirated products, has not yet be able to be prevented, except when one-time employment of the ink tank cassette is compelled, as proposed in German Patent 196 13 945. An ink connecting line from the ink print head is docked to the container with a hollow needle via a rubber-elastic closure. A cover mechanism that serves as a re-employment block is irreversibly triggered by the hollow needle when the container is pulled off. A refilled ink reservoir can no longer be docked. Unfortunately, this solution also prevents the re-employment of recycled containers filled with original ink. The used ink tanks only can be returned to the dealer or the manufacturer's service department for proper disposal. The use of exactly copied pirated ink reservoirs, unfortunately, also cannot be prevented in this device.

SUMMARY OF THE INVENTION

An object of the present invention is to provide a method for determining the number of normal imprints that can be printed with a quantity of ink remaining in an ink tank cassette which is suitable for a device with an ink jet print head that must be cleaned at intervals, whereby an amount of ink is consumed that is affected by a tolerance. The calculated quantity of remaining ink should nonetheless deviate so little from the actually available amount at the end of ink that a last normal imprint is certain to be completely printed and that a quantity remains in the ink tank cassette that is less than that required for a normal imprint. Although an employment of a refilled ink tank should be tolerated, the employment of expired, old inks for refilling an ink tank or of ink having poor quality should be made more difficult and, ultimately, largely minimized, particularly with pirated products.

The invention is based on the perception that it is of no interest whether the indication of the available ink quantity is precise at the beginning of consumption. On the contrary, the precise indication of the remaining quantity as the end of consumption approaches is of interest. After a rough identification of the remaining ink quantity, thus, an averaging over the number of normal imprints that are still possible can ensue. A pre-condition for such an averaging is the validity of an input authorization code for an ink tank cassette. The fine computational determination of the remaining number of normal imprints only ensues after a predetermined remaining ink quantity is acquired by a sensor and signaled. In the inventive method, beginning with a predetermined point in time, the number of rinses and the number of different normal imprints are taken into consideration in the computational determination, and the remaining amount is displayed as a whole number of normal imprints. The sensor acquired, predetermined remaining ink quantity is a reserve quantity intended for consumption that enables a predetermined number of normal imprints beginning with aforementioned point in time. A cleaning procedure is prevented when the ink consumption is higher than the ink consumption for a normal imprint.

The normal imprints that can be performed with an ink tank fill of the replaced ink tank cassette are identified in a rough approximation and in a user-specific manner. The most frequent user or users are acquired and the consumption is converted into the corresponding number of franking imprints either computationally or on the basis of empirically acquired data.

Experience has shown that the amount of mail franked by a user with the postage meter machine after every activation until the machine is turned off usually does not lie far from an average number of normal imprints. The latter, however, can vary greatly from user to user. For this reason and because a cleaning cycle with considerable ink consumption is triggered every time the machine is turned on, a user-specific average value thus arises for the consumption per activation cycle, i.e. during operation after turn-on until the postage meter machine is turned off. A user-specific maximum value of normal imprints that can be achieved per ink tank fill is ultimately empirically derived. Proceeding from the average, user-specific consumption, a plurality of average, normal imprints that are still possible can be derived. It is inventively provided that a normalized consumption converted into piece numbers of pseudo imprints or normal imprints is subtracted from a start number. The rough identification of the number of imprints that can be implemented ensues in a user-specific manner by the result of the aforementioned subtraction being multiplied by a yield factor u.

The postage meter machine is inventively equipped with an arrangement for recognizing a necessity for changing the consumable (ink, ink cassette), whereby the check of the validity of an input authorization code being implemented given a change. A remaining quantity of possible imprints is identified and displayed from the very beginning only when the employment of the think tank cassette is authorized. The rough calculation already begins before an output of an end of ink signal, i.e. long before the reserve quantity for consumption is tapped into.

Piracy protection for consumables based on the authentication and authorization thereof can ensue with a self-check by the device or an external check. The device has an input unit for the authorization code. The manufacturer supplies a code aggregated to the consumable. If the postage meter machine device has a chip card read/write unit available to it, the input of code and, potentially, further data can advantageously ensue from a chip card that was supplied together with the consumable ink tank cassette. The microprocessor of the device is programmed:

to make rough computational determination of the number of normal imprints that can be performed with a remaining ink quantity and for the signaling thereof before a point in time at which the predetermined remaining ink quantity acquired by the sensor is signaled as reserve;

to generate a message after a detection of the replacement of the ink tank cassette and to display it by display and wait for an input of a code with the input means;

to implement a check of the input code for authorizing the replacement ink tank cassette and to modify the operation of the device when the completed check of the code has yielded an invalidity; as well as to make a fine computational determination of the number beginning with a point in time at which the predetermined remaining ink quantity acquired by the sensor is signaled.

An advance signaling is especially advantageous given large-scale users. Via a user interface, the user can freely program a threshold for the signaling as a reference value. This advantage is lost given the use of pirated products or refilled ink tank cassettes. The change in operation of the device can be comprised therein that the need to replace the ink tank cassette is no longer signaled before the reserve quantity for consumption is tapped into.

DESCRIPTION OF THE PREFERRED EMBODIMENTS

Figure 1:
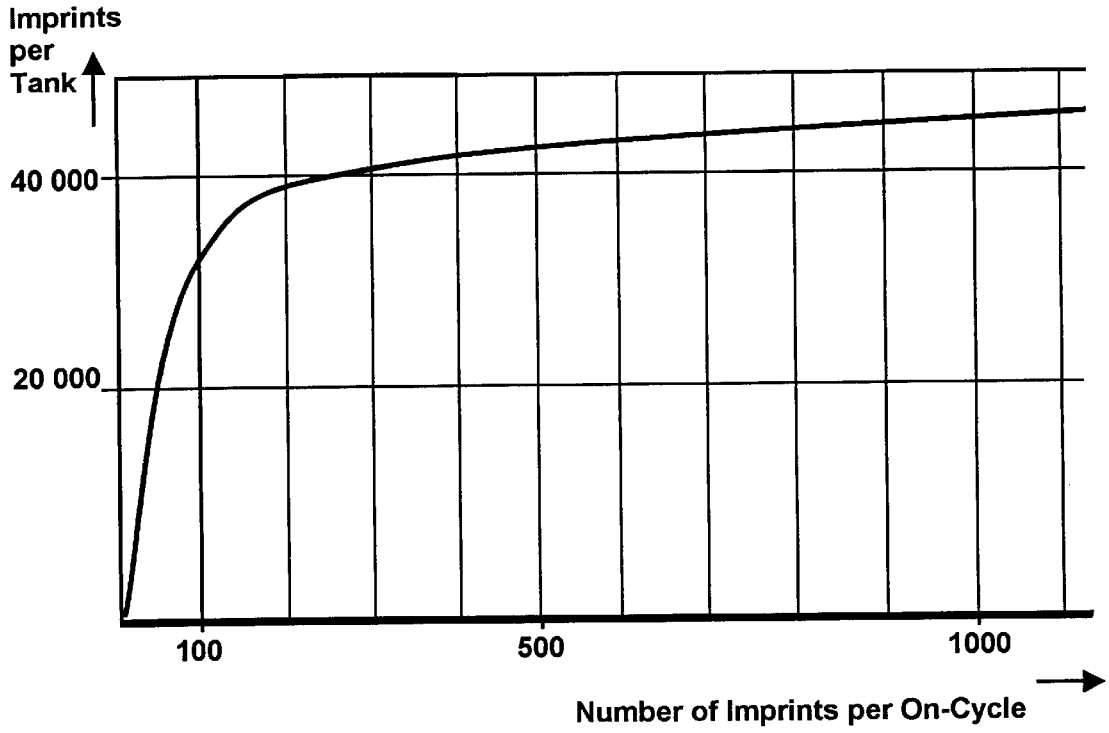
FIG. 1 is an illustration of an example of a user profile-dependent ink tank yield employed in the inventive method and arrangement.

FIG. 1 shows an illustration of the user profile-dependent ink tank yield for the ink tank cassette that is employed in the postage meter machine of the JetMail® type. After the postage meter machine is turned on, a cleaning (priming) of the ink jet print head is automatically implemented. When the postage meter machine is turned on often and only little mail is thereby franked, the cleaning uses comparatively much ink. When, however, the number of normal imprints per on-cycle is increased, i.e. in the operating time span after a turn-on event, then the ink consumption due to printing increases relative to the ink consumption due to cleaning. Moreover, the postage meter machine automatically triggers a cleaning at regular intervals of approximately 1000 frankings and after longer printing pauses, for example after 12 hours. In normal operation, this always assures a faultless print quality. A non-linear curve as shown in FIG. 1 thus derives. The ink consumption unnecessarily rises given excessively frequent cleaning. For this reason, the cleaning sequences automatically, whereby a predetermined quantity $Q_i$ of ink (in ml) is used each time. It follows as a rule that a one-time cleaning before franking suffices for a good printing quality when not very much mail is franked. The sum of all quantities $Q_i$ of ink used during cleaning reaches a maximum value $Q_{max}$ at i=n on-cycles. Given i<n on-cycles, the sum Q can be subtracted from the fill quantity B of the ink tank, so that a remaining quantity of ink (in ml) usable for further normal imprints and cleanings approximately derives as a difference D according to Equation (1):

$$D = B - Q = B - \sum_{i=0}^{n} Q_i \quad \text{[in ml]} \tag{1}$$

An ink tank container holds, for example, a quantity B=360 ml of ink. In the extreme case of a user who franks very little mail, up to 90% of the ink will be used for cleaning purposes. The quantity $Q_{max}$ agrees with the quantity B in a rough approximation. Such low-usage frankers frank fewer than 50 letters per operation after every activation of the postage meter machine. Due to the number of cleaning events, a filled ink tank suffices for only approximately 20,000 normal imprints.

Users who process fewer than 200 letters per on-cycle, i.e. frank fewer than 200 letters per operation after each activation of the postage meter machine, are referred to as low-usage frankers and thereby still use 60% through 80% of the ink for cleaning events. A filled ink tank then only suffices for up to approximately 30,000 normal imprints.

Users who process fewer than 1000 letters per on-cycle, i.e. frank fewer than 1000 letters per operation after each activation of the postage meter machine, are referred to as medium-usage frankers. When they thereby use 30% through 60% of the ink for cleaning events, a filled ink tank suffices for more than 50,000 normal imprints.

Users who process more than 1000 letters per on-cycle, i.e. frank more than 1000 letters per operation after each activation of the postage meter machine, are referred to as high-usage frankers. Since only 20% through 30% of the ink is used for cleaning purposes, a filled ink tank suffices for significantly more than 60,000 normal imprints.

The curve in FIG. 1 derives from the empirical values of a statistical investigation. This also supplies initial values for the approximate calculation of the remaining ink quantity and the number of possible frankings deriving therefrom. In simplified terms, the ink quantity that is consumed overall corresponds to the sum of all normal imprints A multiplied by the average ink quantity q in ml used in the individual franking. The following thus derives for an ink tank fill quantity B:

$$B = Q_{max} + \Sigma A * q \text{ [in ml]} \tag{2}$$

The ink quantity $Q_{max}$ can be converted into a number of pseudo imprints A' that are lost for a franking due to the cleaning events. The difference D that derives from Equation (1) can then be converted into a number of normal imprints, rounded to a whole number of normal imprints. The difference D is divided into a sum of pseudo imprints A' and a sum of normal imprints A corresponding to the user-specific behavior and an ink residue that can be neglected here:

$$(\Sigma A'+\Sigma A)q<B-Q \text{ [in ml]} \quad (3).$$

The cleaning must be manually triggered as an exception only when the quality of the franking stamp imprint is no longer adequate, for example due to voids in the printed picture elements (pixels). The curve shown in FIG. 1 thus varies greatly from user-to-user. A pre-calculation of the remaining number of possible normal imprints is obviously more problematical than a calculation of consumption. A user could be surprised by the premature end of the ink in the ink tank. What must be avoided is that a franking imprint that has already been debited cannot be completely printed. An end of ink signal therefore must already be emitted when the remaining number has shrunk to 200 normal imprints. The normal imprints should, in particular, be normal franking imprints with an average ink consumption.

The invention allows better utilization of this remaining quantity with a more exact determination of a remaining number of possible, normal imprints on the basis of a remaining ink quantity in an ink tank that involves both the previous end sensor and is also based on a more precise calculation of the ink usage. Conventionally, the use W*F of ink for a number W of rinses of the ink jet head was left out of consideration in the calculation since it is less than the use q for an average imprint A (normal imprint). The following derives from Equation (2):

$$B=Q_{max}+\Sigma A*q+W*F \text{ [in ml]} \quad (4),$$

whereby q=6F (in ml) and F is the ink consumed for a rinse.

A high ink consumption is disadvantageous when only a residue of ink is in the ink tank cassette. A generated message therefore appears in the display when the ink supply is no longer adequate for a franking with preceding print head cleaning. This is the case when the remaining ink quantity has shrunk to a value c1*q that, for example, enables c1=200 normal imprints $A_3$ when an end of ink is detected. A consumption q=6F is valid for normal imprints $A=A_3$. A minimal imprint $A_1$ incurs a lower consumption 4F and a maximum imprint $A_5$ incurs a higher consumption 8F of ink than a normal imprint $A_3$. Further imprints $A_2$ or $A_4$ can also lie therebetween during use. Equation (5) can therefore be constructed wherein there is no term for ink head cleaning, and which is valid only after and end signal has been emitted.

$$c1*q=\Sigma A_1 4F+\Sigma A_2*5F+\Sigma A_3*6F+\Sigma A_4*7F+\Sigma A_5*8F+W*F$$

$$c1*q=200*q=200*6F \text{[in ml]} \quad (5).$$

Equation (6) applies when the remaining number c1 has been completely used:

$$c1=(\Sigma A_1*2/3\Sigma A_2*5/6+\Sigma A_3+\Sigma A_4*7/6+\Sigma A_5*8/6+W*1/6) \quad (6).$$

Consequently, a number of frankings derives when the normalized usage is subtracted from the remaining number c1 and then rounded. A rinsing (flush) reduces the ink consumption by less than an average franking imprint. Since this was included in the calculation as a normalized numerical value 1/6, knowledge is achieved that the remaining ink quantity is still sure to suffice for a greater number of imprints, and it is alternatively possible to frank smaller quantities in stacks, whereby a printing pause is also allowed to precede the franking of the next stack. The differences in consumption among the individual imprints enter into a numerical value Z. A normal imprint is given the numerical value Z=1 and a minimal imprint is given the numerical value Z=2/3. After an end signal has been emitted, Equation (7) thus derives for the number of remaining imprints after each printing:

$$K=c1-Z, \text{ whereby } 2/3\leqq Z\leqq 4/3 \quad (7).$$

The user, however, is only shown the full numerical values for K (without decimal points). Inventively, an exact calculation only begins when an end of ink is detected. A safety margin then can be selected adequately small without the ink being exhausted earlier than calculated. This safety margin can constitute a quantity of ink that is used for a single maximum imprint $A_5$. A simplification derives when Z=1 is selected and the rinsing is left out of consideration and a larger safety margin is selected instead.

Figure 2:
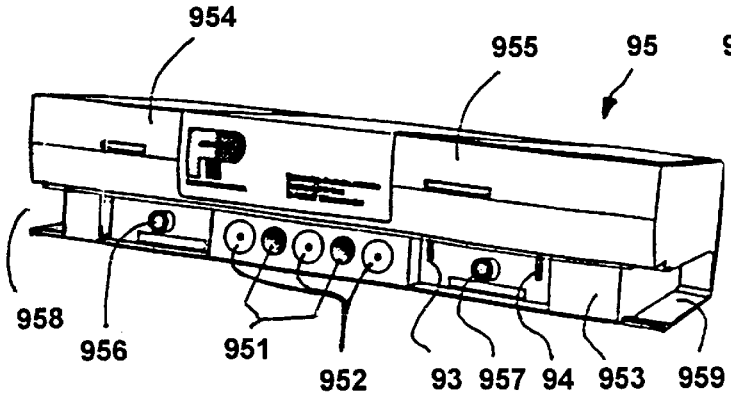
FIG. 2 is an illustration of the back side of an ink tank cassette.

FIG. 2 shows an illustration of the back side of an ink tank cassette of the JetMail® type postage meter machine. An ink tank reservoir 955 of the ink tank cassette 95 holds about 360 ml of ink and serves for the ink supply. It is equipped with an electrode pair 93, 94. A sensor 92 connected thereto supplies an end of ink signal when the has been emptied except for a residual amount. When a signal is then given that the level to be detected has been downwardly transgressed, ink authorized by the manufacturer can be refilled into the ink reservoir for ink supply. This, for example, can ensue via a hollow needle or syringe through a rubber seal 957 in the back wall of the ink tank cassette. The ink suctioned in during priming proceeds into a second ink reservoir 954 for ink disposal through a second rubber seal 956 in the back wall of the ink tank cassette 95. A perforation encoding has holes 951 and holes covered with cover 952. As an alternative to the covers, a perforation of the intact back wall can ensue. The perforation encoding protects against mix-ups with ink tank cassettes that are filled with ink having a different color. Lateral channels 958, 959 serve as guides for insertion of the ink tank cassette.

Figure 3:
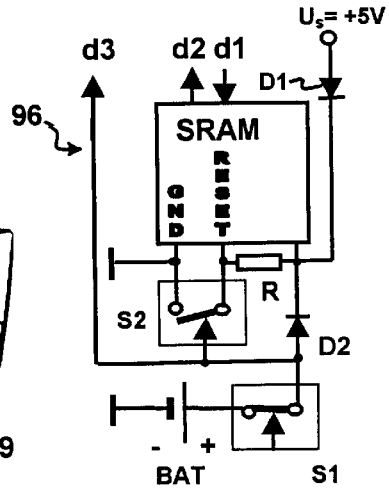
FIG. 3 is a block circuit diagram of a detector for recognizing the changing of an ink tank cassette employed in the inventive arrangement.

FIG. 3 shows a circuit diagram of a detector that is also sure to detect the removal or replacement of the consumable when the device is turned off and not supplied with system voltage $U_s$. The detector has a commercially obtainable lithium battery BAT that supplies a memory with a memory maintenance voltage of approximately 3 V. A first switch SI is actuated upon removal or replacement of the consumable. For example, a mechanical contact is opened that interrupts the voltage supply of the memory from the lithium battery BAT. This voltage supply is detected and causes the closing of a second switch S2 that is preferably realized as a CMOS circuit. The reset input of the memory is thereby connected to ground (L level), which leads to the non-volatile storage of the information about an interruption of the presence of the ink tank cassette by dependable erasure of the memory content of the memory. Otherwise and with the device turned on, a positive voltage $U_s$=+4.5 through +5 V (H level) is present at the reset input via a resistor R and the diode D1 or—with the device turned off—a positive voltage $U_{BAT}$=+2.5 through +3 V (H level) is present via the diode D2. The memory can be fashioned as an SRAM that is equipped with a code by the microcomputer 19 via the interface 18 by means of a shift register (not shown) and that can be queried with respect to the presence of the code. The data query following a removal or replacement of the ink tank cassette symbolized by d1, d2 can be supplemented by a data query with respect to whether the ink tank cassette is fully inserted, symbolized by d3. A mechanical contact or, respectively, first switch SI that produces the voltage supply of the memory with the lithium battery BAT is closed when the cassette is fully inserted. Moreover, the voltage level of the lithium battery BAT can be interrogated via d3 and window comparators (not shown).

The manner by which the consumable to the code word are aggregated is preferably dependent on the nature of the consumable. A sensor directly or indirectly allows the presence of consumable to be identified according to a physical interactive principle, whereby the consumable is a solid. Here, the consumable is the ink in an ink tank cassette for a postage meter machine according to FIG. 4.

Figures 4, 5:
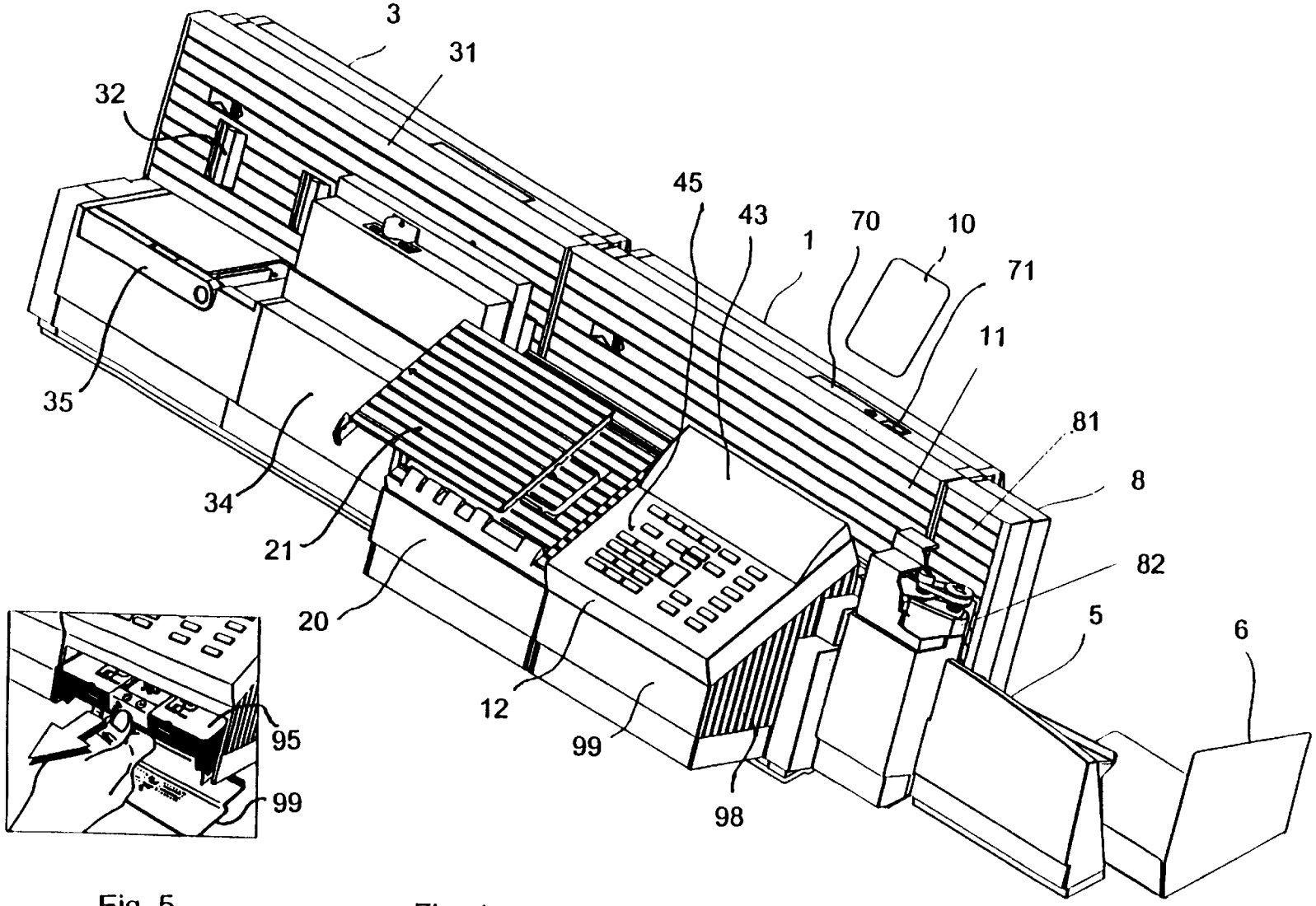
FIG. 4 is a perspective view of a JetMail® postage meter machine of the type from the right front.
FIG. 5 is an illustration of the changing of the ink tank in the JetMail® postage meter.

In the perspective view from the right of a JetMail® type postage meter machine shown in FIG. 4, there is an internal data connection to the integrated scale 20. An automatic feeder 3 with integrated separating mechanism is arranged upstream of the postage meter machine 1. A pressure bow 35 can be hinged up and then presses against a stack of mail from which letters are separated with haul-off rollers 32. Further parts of the separating mechanism are situated under a hood 34. A letter lies against a guide plate 31 and is moved downstream to the guide plate 11 of the postage meter machine 1 where the printing event called "franking" ensues. A franked letter that is conveyed farther lies against a guide plate 81 of a closing module 8. A closing roller pair 82 closes any envelopes that have not yet been completely closed and ejects the closed envelopes on via an insert 5 into the deposit box 6. The structure of the JetMail® type postage meter machine has been disclosed in greater detail in, for example, German Patent Application DE 199 00 686.5-27.

A chip card write/read unit 70 and an on/off switch 71 are arranged in the guide plate 11 of the postage meter machine 1. After being turned on, a chip card 10 can be employed in combination with the user interface 43, 45 for simplified setting of the postage meter machine. The user interface 43, 45 is situated on the meter 12 of the postage meter machine 1. An internationally usable user interface has been set forth in greater detail in German Utility Model 298 21 903.

A microprocessor (not shown) of the postage meter machine 1 monitors the filling level of an ink tank 95 (shown in FIG. 5) with an end of ink sensor 92. The latter can be in contact with two electrodes according to German Patent 196 13 944. In the JetMail® model, such sensors—to be on the safe side—already supply an end signal when a maximum of 200 frankings are still possible in order to avoid an incompletely printed franking print image due to lack of ink. As warranted, the microprocessor generates a display text for display in the display 43: THE INK SUPPLY HAS BEEN NEARLY USED UP. PLEASE REPLACE THE INK TANK AS SOON AS POSSIBLE! IMPRINT RESERVE: 200.

The postage meter machine 1 can then continue to be operated with the quantity of reserve ink. In its memory space, the microprocessor has a down counter that is preset to the number 200 by the end of ink signal and that is decremented by one with every further franking. The number 200 is derived empirically from values for a remainder of possible imprints and a safety factor. The number identifying the remainder can be displayed before the next franking. Alternatively, a remainder of possible imprints can be more exactly determined when the aforementioned Equation (5) forms the basis. The more exact calculation is explained in greater detail with reference to FIG. 8.

After every further franking, the microprocessor generates a status line that indicates the number of remaining imprints and, at the end, outputs the message: THE INK SUPPLY HAS BEEN USED UP. PLEASE CHANGE THE INK TANK.

After opening the flap 99 of the ink compartment 98, the used ink tank 95 can be removed and placed into a plastic bag that collects ink residues that potentially run out. A new ink tank can be taken from its package and thereby checked to see whether the color of the ink is right. A perforation encoding on the back side of the ink tank can be utilized for this purpose. The new code word can be read at the same time. The ink tank is placed into lateral guide rails (not shown) of the ink tank compartment and pushed in until it noticeably engages. As long as the ink tank has not been properly inserted, the microprocessor generates the message: PLEASE CHANGE THE INK TANK!

A contact is automatically closed when the new consumable is docked. As a result of this contact, the postage meter machine recognizes that a new consumable has been installed. Dependent on a perforation encoding at the back side of the ink tank, the original ink type (postal red, fluorescent red, etc.) can be detected with suitably fashioned contacts. The microprocessor now generates a messages that prompts the customer to input the new code word: PLEASE INPUT INK TANK CODE. For example, the customer can take this code word from an imprint on the package and can enter it into the postage meter machine 1 with the keyboard 45.

Now that the postage meter machine 1 has the new code available to it, a connection is set up to the data center of the manufacturer. Modern postage meter machines are all already equipped with a modem in order to be able to communicate with the manufacturer's data center. This normally serves for having a credit loaded from the data center when the corresponding memory was franked empty. The transmission of the code can ensue separately immediately after the detection of the new consumable or can be an additional component of the communication for the periodic remote crediting of the postage meter machine at a later time. Known measures of data protection are utilized in order to prevent the code from being tapped on the transmission link. The data center receives the code of the new consumable 95 together with an identifier of the postage meter machine 1. In the comparison of the code implemented in the remote data center 100 (schematically shown in FIG. 6), a check is also carried out to determine whether the code had already been employed. If it has been reported from a different postage meter machine, the user thereof obviously passed the code on, and the new customer is attempting to employ unauthorized consumables in combination with this code. If the customer himself has already previously specified the code, this is an indication that, after having used authorized consumables, that customer has now obtained possession of unauthorized consumables.

Alternatively, the authorization can be checked in the device itself, which shall be explained later on the basis of FIG. 9.

Figure 6:
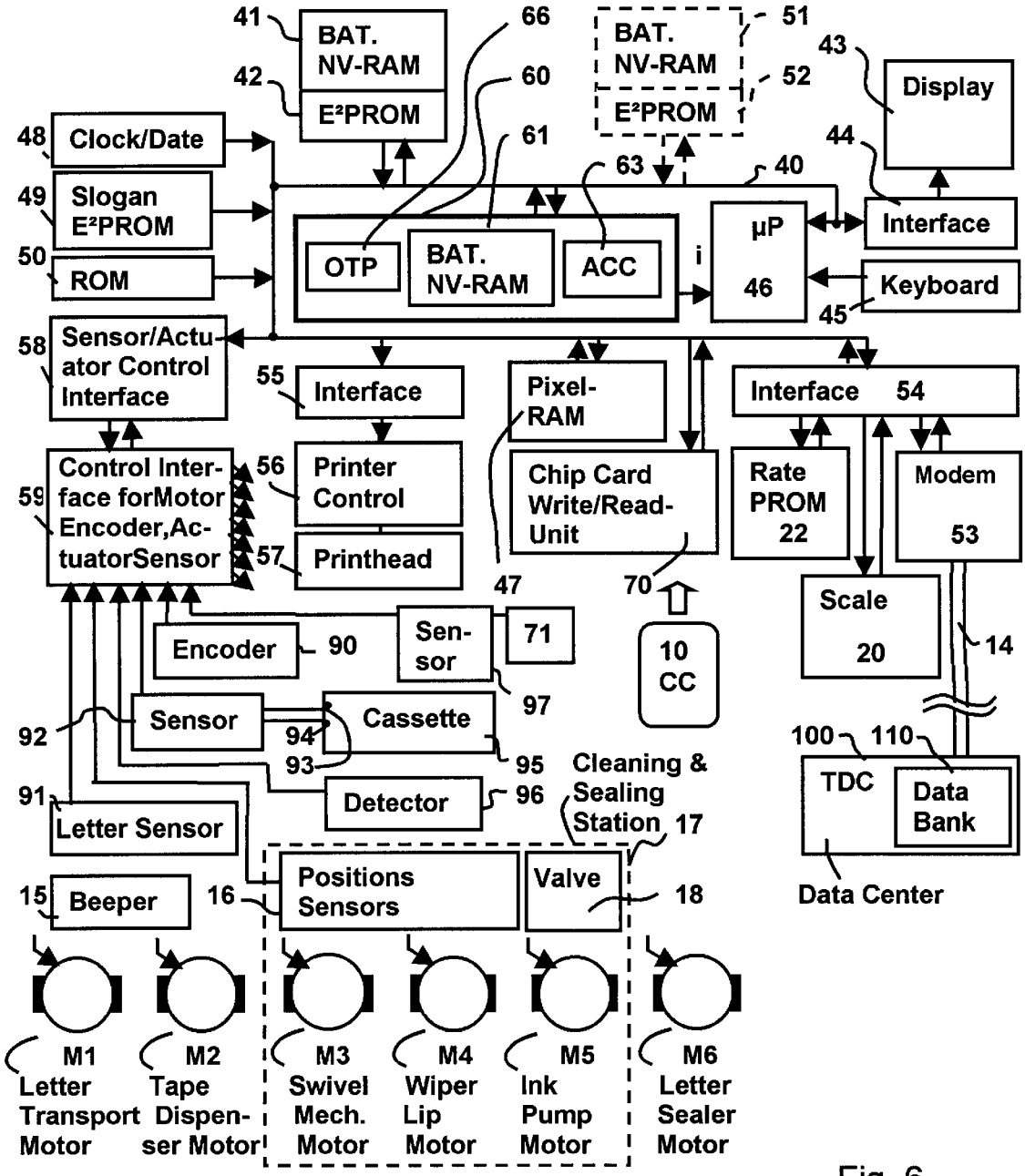
FIG. 6 is a block circuit diagram of the JetMail® postage meter machine.

FIG. 6 shows a block circuit diagram of the JetMail® type postage meter machine with a control unit 40 through 58 comprising a processor 46 and with a base including an integrated scale 20, a rate PROM 22, a modem 53 and a detector 96. Alternatively, the rate PROM 22 can be realized in the broken-line memory module 51, 52 within the meter.

In conformity with a direct measuring method, the detector recognizes the changing or the insertion of a new ink tank cassette 95. It is also provided that, using existing sensors 92, 97 in interaction with an interpretation of measured and stored data carried out by the microprocessor 46, the presence of a replaced ink tank cassette is indirectly identified according to a physical interactive principle. After a consumption of the ink, a predetermined remainder of ink is detected with the electrodes 93, 94 and the sensor 92 and communicated to the microprocessor 46 via the assemblies SAS 59, sensor/actuator control interface ASIC 58, the microprocessor 46 subsequently generating a display. A predetermined remainder of ink remains that suffices for approximately 200 imprints when the conductivity between the contacts 93, 94 falls below a predetermined threshold. A turn-on/off of the postage meter machine 1 via the switch 71 can be detected via the sensor 97, which is likewise connected to the SAS 59. Together with an interpretation of measured and stored data carried out by the microprocessor 46, the presence of an ink tank cassette 95 that has been replaced in the meantime is indirectly identified. Storage of the item count for normal imprints=frankings ensues during operation of the postage meter machine, and the microprocessor of the postage meter machine recognizes an unauthorized replacement if an incongruity exists between the number of allowable frankings identified from the input of the authorization code and the actual franking performance. A shutdown at the time during which the postage meter machine only has the ink remainder available to it can indicate an impending replacement. If, following a re-activation without a replacement detected via the contacts 93, 94 and the sensor 92 for restored conductivity between the contacts 93, 94, the postage meter machine can continue to be operated beyond a number of, for example, 200 imprints, then this is an indication that ink was refilled in an unauthorized fashion in the interim. As a reaction thereto, a display is at least generated and a message can be communicated to the data center when credit must be reloaded.

A security module 60 serves as a first accounting module and has a hardware accounting unit 63 and a battery-supported non-volatile memory 16 into which a credit can be loaded by modem 53. An OTP (One-time programmable) processor 66 implements security routines in the credit reloading as well as for securing the register data with a MAC (Message authentication code). The advantage of the security module is that the check of the dependability and the approval of the inventive franking and posting machine, which is carried out by the mail carrier, is then only required for the appertaining processor system 60 and the connected printer module 55–57. A second processing module is formed by the chip card 10 in combination with the chip card write/read unit 70. The microprocessor 46 and the first memory components 41, 42 then form a third processing module, and the microprocessor 46 and the second memory components 51, 52 (broken lines) then form a fourth processing module, etc. As a rule, one accounting module suffices and the other processing modules can assume other tasks.

The microprocessor 46 with appertaining memories is employed as a postage computer and for the print control and the accounting module 60 serves for accounting and for calculating encryption codes at least for the communication with the data center for the purpose of credit reloading. The accounting module 60 forms the security module on the basis of this division of tasks. All processing modules 41, 42 and 51, 52, the security module 60, the microprocessor 46, the interface assemblies 44, 54 and 55, a main working memory pixel-RAM 47, clock/date module 48, slogan memory EEPROM 49, program memory ROM 50 and an ASIC with the sensor/actuator interface 58 are connected to a meter-internal bus 40 of the controller. An input at the ports of the microprocessor 46 for the corresponding control of the postage meter machine 1 is actuated with the keyboard 45. A generated screen image can proceed to the display via the interface assembly 44. The display has an integrated controller for support. Further sensors and actuators (not explained in greater detail here) of the base, an encoder 90 for weighing a letter and at least one letter sensor 91 as well as—via the interface 54—at least the modem 53 are electrically connected to the meter 12 of the postage meter machine 1 via the sensor/actuator control interface 58. Both interface circuits 54 and 58 can be realized in an application circuit ASIC. Further details about this can be derived from European Application 716 398. Further details about the control of the other components in the base and in the periphery can be derived from European Application 875 864.

A motor M3 for the swivel mechanism, a motor M4 for a wiper lip and a motor M5 for an ink pump exist in addition to the motor Ml for the letter transport, the motor M2 for a tape dispenser and the motor M6 for a letter sealer. A beeper 15 and cleaning and sealing station position sensors 16 that identify the movement of the motor M3 for the swivel mechanism and, thus, the movement of the cleaning and sealing station 17 are connected to the SAS 59. The beeper 15 briefly signals a malfunction, for example given a pulling of the mains plug, when the print head is not sealed. It uses only little energy for signaling.

The print head is sealed when a sealing cap of the cleaning and sealing station 17 is lifted to a sealing position. This is not the case in the franking mode since the print head was swivelled into a franking position. A cleaning of the print head is undertaken in conjunction with the control of the three aforementioned motors M3, M4, M5. A cleaning comprises proceeding through the phases of extraction, wiping and spraying, whereby the procedure is realized by the operation of the motor M3 with a specific mechanism. After an under-pressure has been generated due to the activation of the ink pump motor M5, the swivel mechanism opens a valve 18 and an amount of ink predetermined by a priming time duration is extracted. After the priming, the sealing cap is lowered into a wiping position and a wiping of the print head ensues by driving the motor M4 for the wiper lip. A spraying also ensues after the ink pump motor M5 is shut off, by driving the piezo actuators of the print head are drive with pulses for a predetermined time duration. When no print job is present, the cleaning and sealing station 17 is docked and the valve 18 is closed. The structure and the function of the cleaning and sealing station 17 is described in greater detail in German Patent 197 26 642.

Figure 7:
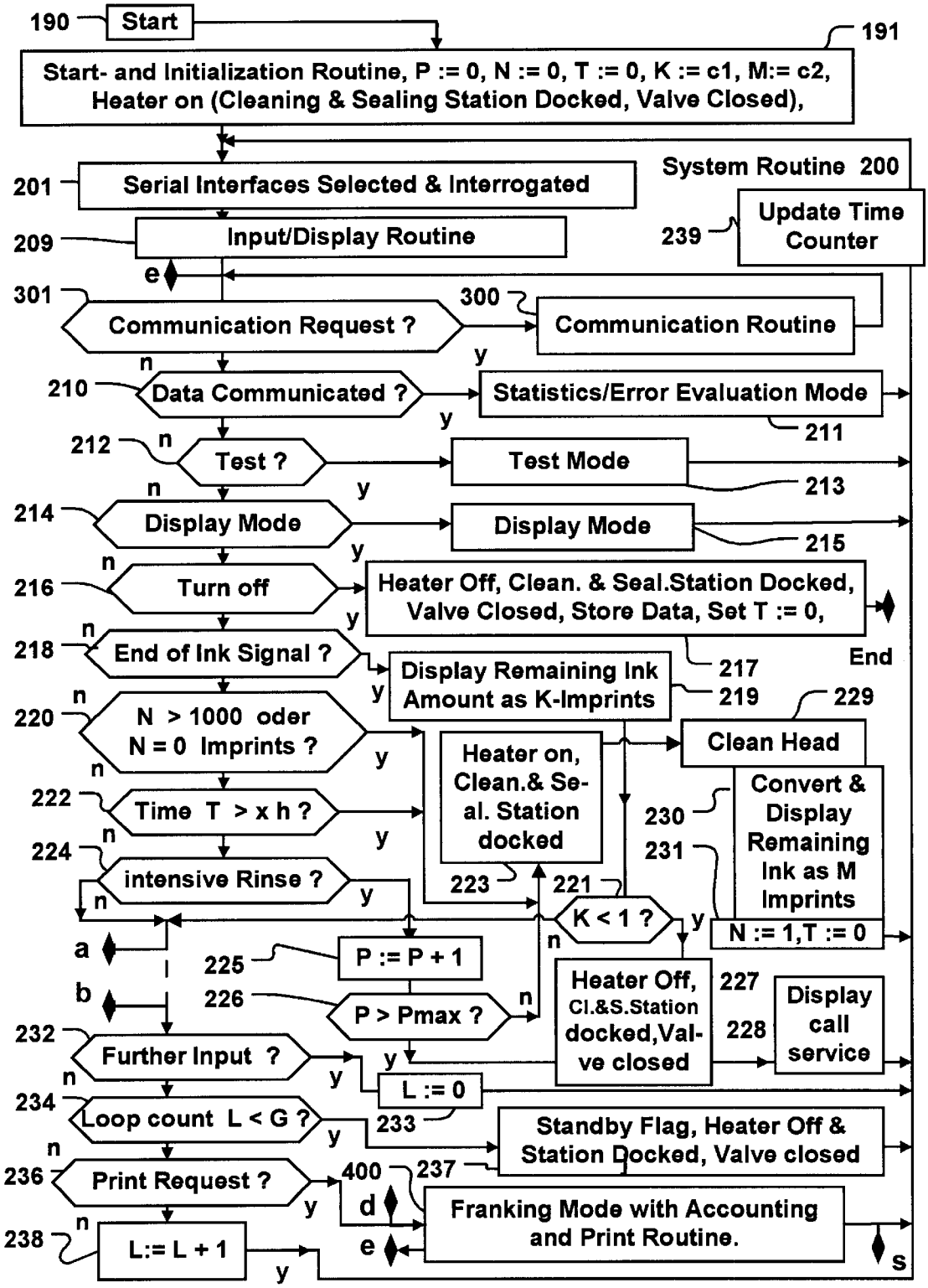
FIG. 7 is a flowchart for the JetMail® postage meter machine.

FIG. 7 shows a flowchart for the aforementioned postage meter machine. The system routine 200 is reached after the start 190 and the implementation of a start and initialization routine 191. In the step 201, the serial interfaces, for example the interface 54, are selected and interrogated, and other stored data are retrieved. A branch is then made to the step 209, potentially via further steps (not shown). Further data and instructions are emitted in an input and display routine, whereby the input possibilities are predetermined by the user interface via the screen images. A point e preceding an interrogation step 301 is now reached. An input can be recognized as a communication request in the interrogation step 301, whereupon a communication routine 300 is executed before a branch is made back to the point e. If, however, an input is not recognized as communication request in the interrogation step 301, then a branch is made to the next interrogation step 210. If it is recognized in the step 210 that data have been communicated to the postage meter machine during the preceding communication, then a return branch is made to the system routine 200 via a statistics and error evaluation mode 211 and an updating step 239. Otherwise, a branch is made to the next interrogation step. In the updating step 239, a time counter for the duration of the operation of the postage meter machine after being turned on is updated, this having been initially set to T:=0 but having been started after the turn-on. Independently thereof, the time counter can also be updated every second.

A command to enter into a test mode 213 is recognized in an interrogation step 212. A command to enter into a display mode 215 is recognized in an interrogation step 214. If the command "turn off" is recognized in an interrogation step 216, the heater of the print head is turned off in a step 217, the cleaning and sealing station 17 is docked and the valve 18 is closed. Moreover, the time counter is reset to T:=0 and the current data are stored. The current data include an item count H of pseudo imprints or imprints corresponding to a normalized use and a yield factor u. Immediately following a reactivation and after the end of a cleaning procedure, a remaining number $M_{act}$ of normal imprints calculated from the values H and u can be displayed in the display mode 215. A rough calculation that shall be explained below is carried out for this purpose.

When the sensor 92 emits an end of ink signal, this is recognized by the microprocessor in the interrogation step 218 and a branch is made to the display step 219; wherein the remaining amount of remaining ink is displayed in the form of K imprints. A branch is then made to the interrogation step 221. If the amount of remaining ink no longer suffices for an imprint, then a branch is made to a step 227. In step 227, the heater of the print head is turned off, the cleaning and sealing station 17 is docked and the valve 18 is closed. Subsequently, a return branch is made to the system routine via a display step 228. Otherwise, a branch is made at a point 'a' to the next interrogation step. Interrogation steps 220, 222, 224 that trigger a cleaning of the ink print head can only be executed when the end of ink signal is not present.

In the interrogation step 220, a counter started in the start and initialization routine for the item count of imprints is interrogated as to whether N=0 or whether a predetermined number of imprints, for example 1000, were printed in order to trigger a slight cleaning.

In the interrogation step 222, the time counter started in the start and initialization routine 191 is interrogated as to whether a predetermined time duration x of operating duration, for example x=12 hours, has been reached in order to trigger a cleaning.

A query is made in the interrogation step 224 as to whether a command was entered to trigger a thorough cleaning. Given a thorough cleaning, the number thereof being counted separately in the step 225, a branch is made to the interrogation step 226. An inquiry is made in step 226 to determine whether the aforementioned command was successively re-entered so many times that a number Pmax is exceeded. In such an instance, wherein a repeated cleaning was fruitless, the heater 227 is turned off in the step 227, the cleaning and sealing station 17 is docked and the valve 18 is closed. A return branch is made to the system routine 200 via a step 228 for generating a display "CALL SERVICE". Otherwise, a thorough cleaning is triggered, this differing in duration from the others. A branch is made from the interrogation steps 220, 222, 224 to a step 223 wherein the heater is turned on, the cleaning and sealing station 17 is docked and the valve 18 is closed. The cleaning of the print head ensues in the step 229 and was already explained in conjunction with FIG. 6. In a step 230, the remaining quantity of remaining ink is first converted into a possible, current, remaining number $M_{act}$ of normal imprints, taking at least the cleaning duration or thoroughness into consideration, and is then displayed. In the following step 231, the counters are set to N:=0 for the item count and to T:=0 for the time. The system routine 200 is then reached again.

A query is made in the interrogation step 232 as to whether a further entry was made that must still be processed. A loop counter is then set to L:=0 in order to then branch again to the system routine 200.

Otherwise, the loop counter is interrogated in the interrogation step 234 as to whether a predetermined number of loops was counted. Given a specific clock frequency, which determines the turnaround time for a loop, a loop count yields a time, for example 10 minutes. If no further inputs were actuated or processed in this time, a switch is made to a standby mode. A standby flag is set in a step 237, the heater is turned off, the cleaning and sealing station 17 is docked and the valve 18 is closed and branch is made back to the system routine 200. Otherwise, an interrogation step 236 is reached wherein a check is made for the presence of a print request. If no print request is present, a branch is made back to the point s of the system routine 200 via a step 238 in which the loop counter is incremented L:=L+1. Otherwise, a branch is made onto a point d to the franking mode 400.

As already stated, a remaining number K of imprints only has to be calculated more exactly after the presence of an end of ink signal. It fully suffices for preliminary information of the user of a postage meter machine regarding a current remaining number $M_{act}$ for the remaining amount calculated earlier given a higher ink level to only roughly agree with the actual amount of ink. A remaining amount is calculated as follows according to Equation (8):

$$(c2-H)*q=B-(\Sigma N_j+r_2*\Sigma A''+r_3*\Sigma A'')*q \text{ with } H=(\Sigma N_j+r_1*\Sigma A'+r_2*\Sigma A''+r_3*\Sigma A'') \quad (8)$$

A current remaining number $$M_{act}=u*(c2-H) \quad (9)$$

derives therefrom.

In the step 230, a value H is subtracted proceeding from a start number c2. The value H is usage normalized and converted into item counts of pseudo imprints and is stored before the calculation of the remaining number. The item count $N_1$ that occurred following the first cleaning after the start and the item count $N_j$ (with j=2, 3, 4, . . . ) between the cleanings as well as the cleanings themselves, are converted into an item count of pseudo imprints A', A", as soon as one is detected are interpreted in the value H. The factor $r_1$=1 applies given a light cleaning. The factor $r_2$ considers both the cleaning duration and thoroughness in the normal cleaning in contrast to the light cleaning. For example, a normal cleaning leads to twice the ink consumption compared to a light cleaning. The factor $r_3$ considers the cleaning duration or intensity in the thorough cleaning. The latter, for example, leads to twice the ink consumption compared to the normal cleaning. A factor $r_3$ =4 thus derives. Without considering an initial cleaning, the factor r then assumes numerical values between 1 and 4.

An initial cleaning, which leads to a first-time filling of a print head with ink can be taken into consideration in the postage meter machine, possibly with a modified start count c2. The yield factor u takes into consideration that only a portion of the number (c2−H) is directly used for generating imprints. The user-dependent yield factor u must be stored at the first initialization of the postage meter machine and lies in the range between 0.1 and 0.8. A high factor u=0.8 applies to a user in the category of high-usage franker in the explanation of the curve according to FIG. 1.

Figure 8:
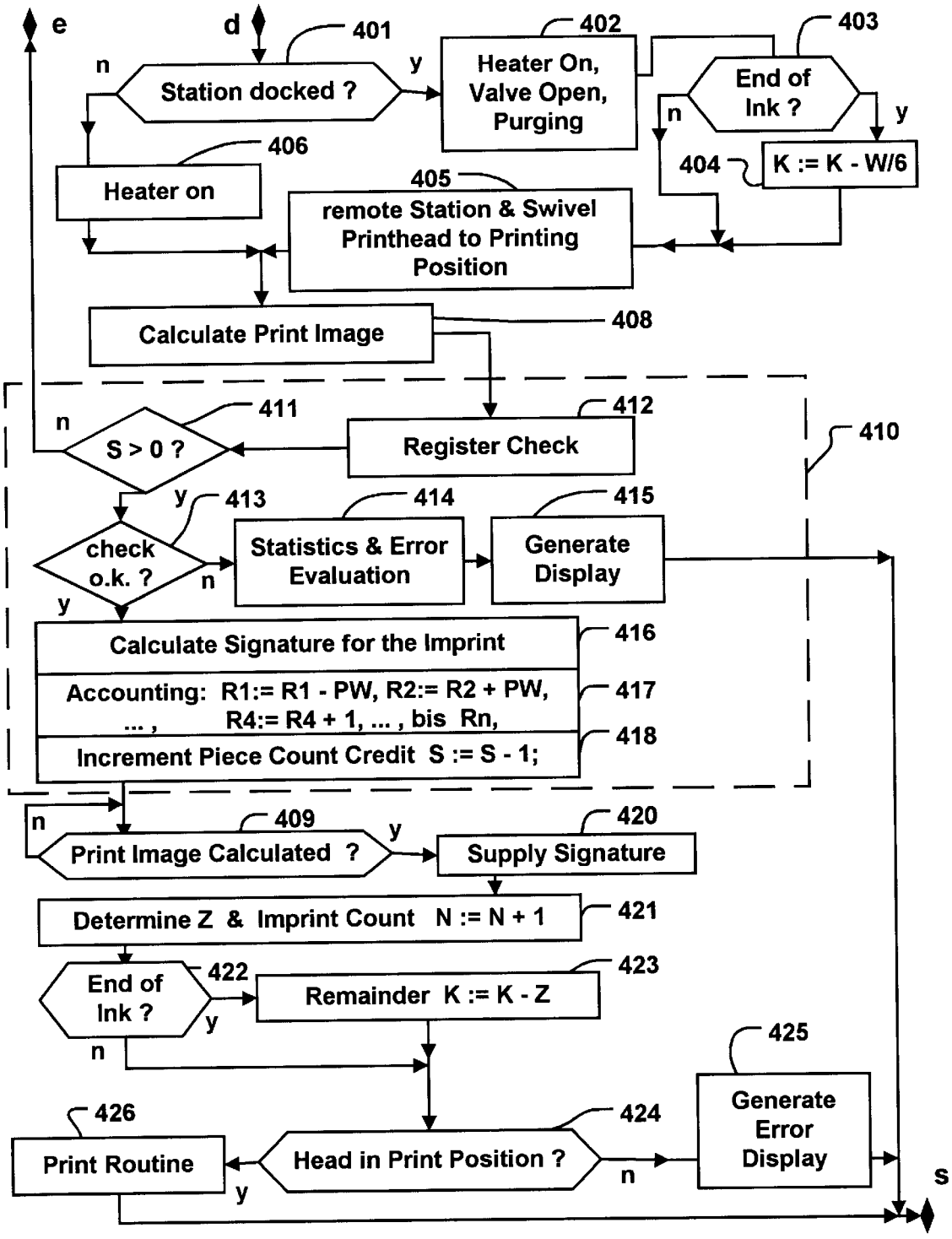
FIG. 8 is a flowchart for the franking mode with routines for accounting, identifying remaining quantity of ink and printing in accordance with the invention.

FIG. 8 shows a flowchart for the franking mode 400 with an accounting and printing routine for the JetMail® type postage meter machine. The determination of a number of normal imprints corresponding to a remaining ink quantity that is still available ensues with the microprocessor 46. When the cleaning and sealing station 17 is not docked (step 401) and the print head heater is turned on (step 401), the microprocessor 46 starts a calculation of the print image (step 408). Otherwise, if it was found in the interrogation step 401 that the cleaning and sealing station 17 is docked, a branch is made to a step 402. In step 402, the print head heater is turned on, the cleaning and sealing station 17 is moved into a wiping position and the valve 18 is opened. A clean-out spray then ensues. When and end of ink signal is present, which is queried in the step 403, the microprocessor—in the step 404—calculates a number K of normal imprints that can still be implemented after the clean-out spray. Subsequently, and if no end of ink signal is present, the microprocessor 46 drives the motor M3 in the step 405 to such an extent that the cleaning and sealing station 17 is lowered into the base and the print head is swivelled into the printing position. The position that has been reached is detected in the step 405 via cleaning and sealing station 17 position sensors 16. Subsequently, a branch is made to the step 408 for the calculation of the print image. The security module 60 is activated during the calculation of the print image by the microprocessor 46. If, following a register check 412, an item count credit S>0 is present (query step 411) and the check yields correct, non-manipulated register data (query step 413), a calculation of a signature for the for the imprint (step 416), the debiting of the printed postage value (step 417) and the incrementation of the item count credit (step 418) ensue. Otherwise, the OTP processor switches the security module 60 to a statistics and error evaluation (step 414) and generates a display (step 415) in order to then branch back to the system routine s.

When the print image has been completely calculated, which is queried in the step 409, the microprocessor 46 can insert the signature supplied by the security module 60 into the print image (step 420). In the step 421, the value Z is subsequently determined dependent on the selected advertising slogan. In the case of a normal imprint, Z=1. The step 421 is also required in order to count the imprints that were printed since the last cleaning event.

The steps 403, 404, 421, 422, 423 required for the determination of a number of imprints corresponding to a remaining ink quantity that is still available are a component of the aforementioned accounting and printing routine. Only an incrementation of the item count N in the step 421 is required for the rough determination of a number of normal imprints. The end of ink signal must have been emitted before a fine determination of a number K of imprints, this being queried in the steps 403 and 422. The start value K is the remaining plurality c1. The consumption that can be exactly determined according to Equation (6) is subtracted as a numerical value from the value K. The consumption enters into a pseudo imprint number W/6 for a spray clean-out in the step 404 and into a number Z for an imprint in the step 423.

Proceeding from the step 423 and when no end of ink signal has been emitted, which is queried in the step 422, the print routine 426 is reached when the print head is in printing position, which is queried in step 424. The print data thereby proceed via the interface 55 and the print controller 56 to the print head 57. An error display is generated in the step 425 if it was found in the latter query that the print head is not in the printing position. At the end, a return branch is made to the system routine. Further query steps can lie between the points 'a' and b of the flowchart according to FIG. 7. A query step that is not shown leads to a step for generating a signaling or alarm before the ink tank cassette must be changed. A numerical threshold I or remaining normal imprints for an alarm/signaling can be pre-programmed by the user with the input and printing routine 109. The current remaining number $M_{act}$ of frankings still possible with normal imprints can be displayed in the display mode 215 when a corresponding input was activated in the input and print routine 109. When $M_{act}$=I, however, a signaling or alarm ensues independently thereof. The other query steps also includes steps that are of significance in conjunction with the authorization of the ink tank cassette.

Figure 9:
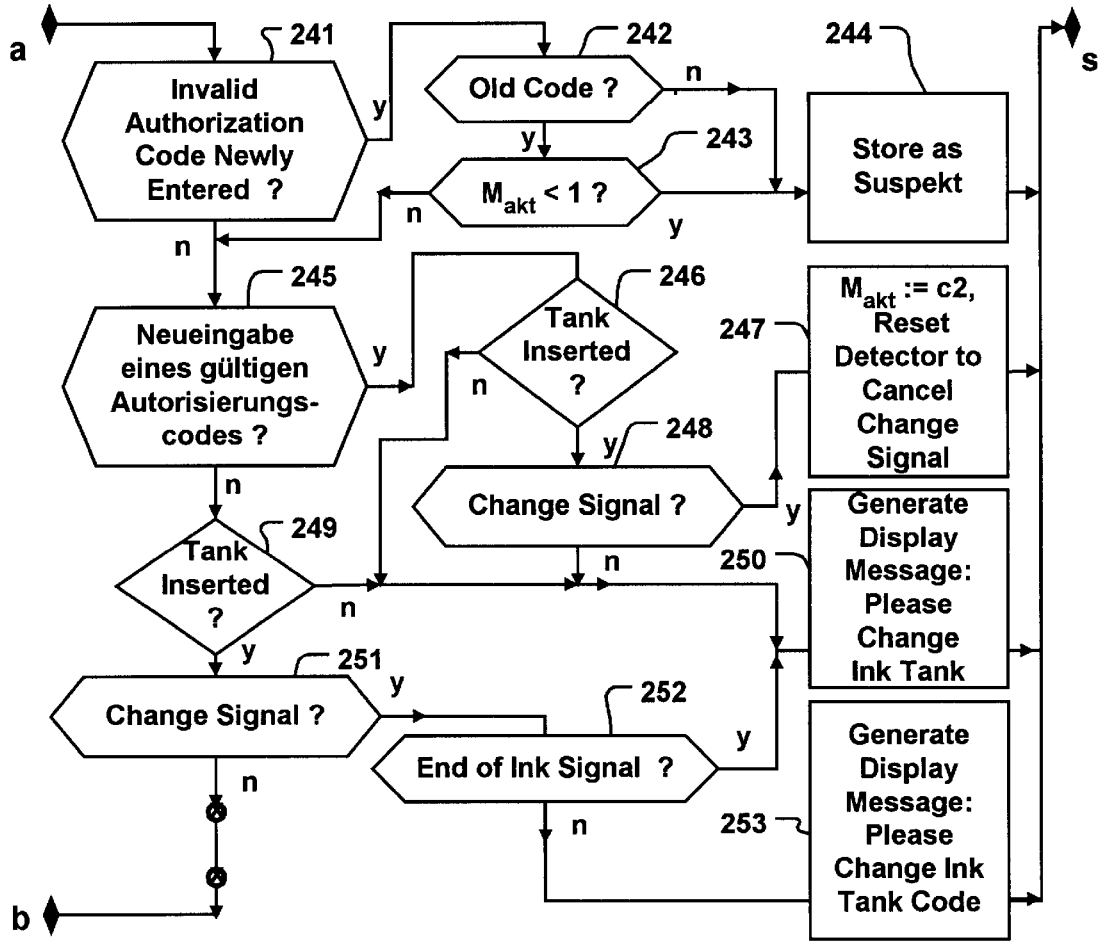
FIG. 9 is a flowchart for the recognition of the replacement of the ink tank cassette in the JetMail® postage meter machine in accordance with the invention.

FIG. 9 shows a flowchart for recognizing the change of the ink tank cassette in a postage meter machine. A query step 241 lies at point 'a' from which a branch is made to a further query step 242 when the user has just newly input an invalid authorization code. In this case, a question is asked in the further query step as to whether an old code was entered. If an old code was not entered, then a branch is made to a step 244 in order to store the information, as a result of which the postage meter machine is suspected of using with ink other than original ink. If, however, an old code was entered, then a branch is made to a query step 243 in order to store the information in the step 244 when the condition $M_{act}$<1 is met. Otherwise, a branch is made from the query step 243 and from the query step 241 to a query step 245 from which a branch is made to a further query step when the user has just newly entered a valid authorization code. In this case, a question is asked in the further query step 246 as to whether the ink tank cassette 95 is plugged in. If this is not the case or when no authorization code was entered and the ink tank cassette 95 is not plugged in, then a branch is made to a step 250 in order to generate a display text "PLEASE CHANGE INK TANK". If it is found in the query step 246 that the ink tank cassette 95 is plugged in, then a branch is made to a query step 248 and a question is asked as to whether a change signal was output by the detector 96. If this is not the case, then another branch is made to the step 250 in order to generate a display text "PLEASE CHANGE INK TANK". Otherwise, if a change signal was emitted by the defector 96, then, in the step 247, the microprocessor sets the remaining plurality $M_{act}$ to the start value c2 and resets the detector 96 into a condition in which no change signal is output. The input authorization code is stored as old code.

If the query step 249 finds that the ink tank cassette 95 is not plugged in, another branch is made to the step 250. Otherwise, given 'yes', a branch is made to a query step 251. If a change signal is emitted by the detector 96, then a branch is made to a query step 252 and a question is asked as to whether an end of ink signal is output by the sensor 92. If this is the case, then another branch is made to the step 250 in order to generate a display text "PLEASE CHANGE INK TANK". Otherwise, a branch is made to a step 253 in order to generate a display text "PLEASE INPUT INK TANK CODE".

When a branch is made to the step 247, of course, the initial condition c2 for the postage meter machine with a maximum counter reading of the remaining number M is again present because the ink tank cassette has just been replaced by an ink tank cassette 95 filled with original ink of an authorized manufacturer.

When a branch is made to the step 253, the ink tank cassette 95—after having been removed from the ink tank compartment—has been reinserted and, for example, is to continue to be employed because it is not yet empty. When the old authorization code is then entered on demand, the aforementioned re-employment is suspected when the current, roughly calculated remaining number is $M_{act}<1$. In such a case, i.e. if the ink tank cassette had not been manipulated by an unauthorized refilling, an end of ink signal would have to have been present. A return branch to the system routine 200 is made from the steps 244, 247, 250 and 253.

In the framework of the input and display routine 109, the microprocessor 46 can distinguish the input of an authorization code from other data inputs. A stored, old code also can be compared to the entered one. In one version, the postage meter machine itself implements the authorization check or, in another version, uses a communication with the data center for the authorization check. The code word is printed on the ink tank cassette or on a label that is secured thereto. Additionally or alternatively, the genuineness of a cassette filled with original ink can be checked. Further query steps that are not shown are required for this purpose. After running the query steps 241, 245, 249 and 251 of the sub-flowchart shown in FIG. 9, the point b is again reached.

Figure 10:
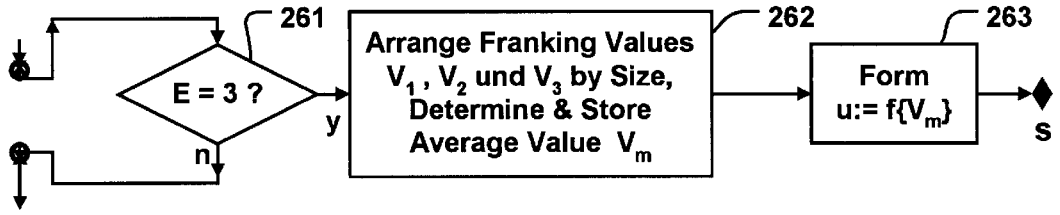
FIG. 10 is a sub-flowchart for determining a yield factor in accordance with the invention.

FIG. 10 shows a sub-flowchart for determining a yield factor u. A query step 261 that queries the number of turn-on cycles E=3 branches to a step 262 in order to arrange the number V of frankings corresponding to the three turn-on cycles according to size and store the average value $V_m$. The calculating step 230 explained in FIG. 7 can contain steps for counting the number of frankings per on-cycle. When N=0, a forward counter for the number V is started. When a shutdown command is recognized in the step 216, the counter value E of the on-cycle counter can be incremented to E:=E+1 in the step 217 and be stored together with the counter value V of the forward counter. After three on-cycles, the user-dependent yield factor u can be determined according to the curve of FIG. 1. A u-factor in a list can be allocated to each identified average value $V_m$. The list can be stored in the ROM 50. It suffices to count the current number V of frankings per on-cycle. The measured values that lie more than three on-cycles in the past and that were stored in the step 263 are erased or were already overwritten.

When an ink tank cassette having a valid authorization code is used, then the necessity or renewed replacement of the ink tank cassette is signaled in advance before the reserve quantity is tapped for use. The display 43 and the input unit 45 form a user interface 4 via which a threshold of the signaling can be freely programmed as a reference value by the user and stored in the memories 41, 42 via microprocessor 46. The memories 41, 42 are equipped for storing at least one threshold in a memory area. The microprocessor 46 is programmed by a program in the memory 50 to compare the identified number of normal imprints implementable with a remaining ink quantity to the reference value and, when the reference value is reached or downwardly transgressed, to generate a signal for the necessity of a renewed replacement of the ink tank cassette. The microprocessor 46 is also programmed to modify the operation of the device when the check of the authorization code that has been carried out has yielded the invalidity thereof, in which case a modification of the operation of the device takes place since the necessity to change the ink tank cassette is not signaled in advance.

The code word can be viewed as a manufacturer's certificate that guarantees the quality of the ink contained therein. Given very important components or consumables, the certificate in the form of an electronically readable signature is issued by the manufacturer remote from the data center, which has a signing key, and the data bank of the data center has a verification key. The identity number of the ink and the quantity sold are encrypted into the signature by the manufacturer using the signing key and are printed on the consumable or its package. A message containing the identity number of the ink, the quantity, potentially the date and the signing key can be communicated to the data center. The data center, upon receipt of the particulars, communicates a verification key with which the postage meter machine can verify a number of filled or refilled ink tank cassettes.

In a further version that the verification or authorization check is only implemented in the data center. It is likewise possible that such checks are implemented in both, i.e. in the data center and in the postage meter machine.

The rough computational determination and display of the plurality of implementable normal imprints before a point in time at which the predetermined remaining ink quantity acquired by the sensor 92 is signaled is especially advantageous to users who belong to the group of medium-usage and high-usage frankers. The ordering of a new ink tank cassette must ensue in time since a remaining 200 normal imprints is used quickly.

Although modifications and changes may be suggested by those skilled in the art, it is the intention of the inventors to embody within the patent warranted hereon all changes and modifications as reasonably and properly come within the scope of their contribution to the art.

We claim as our invention:

1. A method for determining a number of normal imprints implementable with a remaining ink quantity in a printing device having at least one ink jet print head, comprising the steps of:

monitoring an ink quantity in an ink container connected to an ink jet print head as said ink jet print head is operated over time and consumes ink from said container including identifying a quantity of ink consumed by said printer each time as ink jet print head prints a normal imprint and calculating a number of said normal imprints implementable by said ink jet print head using a first computational algorithm;

sensing when a predetermined remaining ink quantity exists as a reserve for printing a predetermined number of imprints with said ink jet print head, and thereupon emitting a sensor signal; and starting from a time at which said sensor signal is emitted, computationally determining a number of said normal imprints implementable by said ink jet print head using ink from said reserve using a second computational algorithm different from said first computational algorithm.

2. A method as claimed in claim 1 comprising periodically rinsing said inkjet print head using ink from said ink tank after said point in time, and computing said plurality of normal imprints dependent on a number of said rinses and a number of imprints after said point in time, and displaying said plurality of normal imprints as a whole number.

3. A method as claimed in claim 1 comprising emitting said sensor signal when a reserve quantity of ink remains in said container for enabling a predetermined number of normal imprints, after said point in time suppressing any cleaning procedure of said ink jet printhead which consumes ink in a larger quantity than a quantity of ink for a normal imprint, and making an exact computational determination of said plurality of normal imprints implementable with said reserve from said point in time.

4. A method for determining a plurality of normal imprints implementable by an ink jet print head with a remaining ink quantity, comprising the steps of:

inserting an ink tank cassette, containing ink, in a printing device having an ink jet print head that consumes ink from said ink tank cassette as said ink jet print head produces imprints;

requiring a code check to validate said ink tank cassette as an authorized ink tank cassette;

upon validation of said ink tank cassette, beginning a rough computation of a plurality of imprints implementable by said ink jet print head dependent on ink remaining in said ink tank cassette;

sensing when a predetermined quantity of ink remains in said ink tank cassette and thereupon generating a sensor signal; and upon generation of said sensor signal, ceasing said rough computation and beginning a fine computation of said plurality of imprints.

5. A method as claimed in claim 4 wherein said rough computation comprises identifying a yield factor which is user-specific with respect to a user of said device, and executing said rough computation by converting said remaining quantity of ink into a count of normal imprints, subtracting said count from a start number to obtain a difference, and multiplying said difference by said yield factor.

6. A method as claimed in claim 5 comprising conducting said rough computation in a microprocessor, and preprogramming said yield factor in said microprocessor.

7. A method as claimed in claim 5 comprising identifying said yield factor during operation of said device during a plurality of on-cycles of said device associated with said user by identifying a number of imprints made during each on-cycle and identifying an average number of imprints per on-cycle.

8. A method as claimed in claim 4 comprising signaling a need to change said ink tank cassette before said ink in said ink tank cassette is depleted to said predetermined quantity.

9. A method as claimed in claim 4 wherein the step of requiring a code check to validate said ink tank cassette as an authorized ink tank cassette comprises entering a code word aggregated with said ink tank cassette into a microprocessor in said device, and checking for validity of said code word in said microprocessor.

10. A method as claimed in claim 9 comprising providing a user interface connected to said microprocessor and entering said code word into said microprocessor via said user interface.

11. A device as claimed in claim 10 wherein said ink jet print head prints postal frankings as said imprint, and wherein said microprocessor identifies a plurality of frankings which has ensued between successive replacements of said ink tank cassette, and identifies replacement of said ink tank cassette as being unauthorized if said number of frankings deviates from a predetermined standard, and wherein said microprocessor, upon identifying an unauthorized replacement, emits a message to a location remote from said device indicating said unauthorized replacement.

12. A device as claimed in claim 11 wherein said microprocessor receives a signal from said remote location identifying whether said number of frankings is plausible since a last credit reloading.

13. A method as claimed in claim 9 comprising storing said code word in a chip card and aggregating said chip card with said ink tank cassette, and providing a chip card reader connected to said microprocessor and entering said code word into said microprocessor by inserting said chip card in said chip card reader and reading said code word from said chip card.

14. A printing device comprising:

an ink jet print head;

a replaceable ink tank cassette containing ink that is consumed by said ink jet print head as said ink jet print head produces imprints, said ink tank cassette having a code aggregated therewith;

a detector for detecting removal and replacement of said ink tank cassette which emits a detector signal upon replacement of said ink tank cassette;

a sensor which emits a sensor signal when a predetermined quantity of ink remains in said ink tank cassette, as a reserve;

a microprocessor connected to said detector and to said sensor;

an input unit for entering said code into said microprocessor; and said microprocessor, upon receipt of said detector signal, waiting for entry of said code and, upon entry of said code, checking said code to validate said ink tank cassette as an authorized ink tank cassette and if said ink tank cassette is not an authorized ink tank cassette, said microprocessor modifying operation of said device and, if said ink tank cassette is an authorized ink tank cassette, said microprocessor beginning a rough computation of a plurality of normal imprints implementable with ink remaining in said ink tank cassette until receipt of said sensor signal, and after receipt of said sensor signal said microprocessor making a fine computational determination of said plurality of normal imprints; and a display connected to said microprocessor, said microprocessor generating a message on said display indicating a need to replace said ink tank cassette, based on said rough computation, at a time preceding receipt of said sensor signal.

15. A device as claimed in claim 14 wherein said predetermined quantity of ink is a first predetermined quantity of ink, and comprising a memory accessible by said microprocessor, and wherein said input unit and said display form a user interface via which a second predetermined quantity is freely selectable by a user and entered into said memory, wherein said second predetermined quantity of ink remaining in said ink tank cassette is greater than said first predetermined quantity of ink.

16. A device as claimed in claim 15 wherein said second predetermined quantity is stored in said memory as a threshold count representing an imprint count, and wherein said microprocessor repeatedly compares said plurality of imprints determined in said rough computation to said threshold count and generates said message indicating a need to replace said ink tank cassette dependent on said comparison.

17. A device as claimed in claim 14 wherein, if said ink tank cassette is not an authorized ink tank cassette, said microprocessor modifies operation of said device by not generating said message indicating a need to replace said ink tank cassette before receipt of said sensor signal.

18. A device as claimed in claim 14 wherein said detector continuously monitors a presence of said ink tank cassette in said device and generates, and non-volatilely stores, said detector signal given an interruption of said presence.

19. A device as claimed in claim 14 wherein said microprocessor identifies a presence of said ink tank cassette in said device dependent on said detector signal in combination with evaluation of additional data.

20. A device as claimed in claim 14 wherein said detector comprises contacts which interact with the ink in said ink tank cassette by a measurement of electrical conductivity of said ink between said contacts, and wherein said measurement is supplied as said detector signal to said microprocessor, and said microprocessor identifying a presence of said ink tank cassette dependent on said detector signal in combination with evaluation of other data.

21. A printing device comprising:

an ink jet print head;

a replaceable ink tank cassette containing ink which is consumed by said ink jet print head as said ink jet print head produces imprints;

a sensor which emits a sensor output indicating a quantity of ink remaining in said ink tank, including a sensor signal indicating when a predetermined quantity of ink remains in said ink tank cassette, as a reserve; and a microprocessor supplied with said sensor output which computes, before receipt of said sensor signal, a number of imprints which can be produced by said ink jet print head using said quantity of remaining ink using a first computational algorithm and which computes, after receipt of said sensor signal, a remaining plurality of imprints which can be produced by said ink jet print head using said reserve using a second computational algorithm different from said first computational algorithm.

* * * * *